US005541698A

United States Patent [19]

Van den Bergen

[11] Patent Number: 5,541,698

[45] Date of Patent: Jul. 30, 1996

[54] APPARATUS FOR PROCESSING PHOTOGRAPHIC MATERIAL AND A METHOD OF REGENERATING A PROCESS LIQUID THEREIN

[75] Inventor: Patrick Van den Bergen, Berchem, Belgium

[73] Assignee: AGFA-Gevaert N. V., Mortsel, Belgium

[21] Appl. No.: 336,684

[22] Filed: Nov. 7, 1994

[30] Foreign Application Priority Data

Nov. 29, 1993 [EP] European Pat. Off. ..... 93203328

[51] Int. Cl.[6] ..... G03D 3/02

[52] U.S. Cl. ..... 354/298; 354/324

[58] Field of Search ..... 354/324, 325, 354/298, 322, 331, 336; 134/64 P, 64 R

[56] References Cited

U.S. PATENT DOCUMENTS 4,629,303 12/1986 Vermarien ..... 354/324 X
5,016,036 5/1991 Nishikawa ..... 354/324 X

FOREIGN PATENT DOCUMENTS 2041569 9/1980 United Kingdom ..... 354/324
203470 10/1982 WIPO ..... 354/324

*Primary Examiner*—D. Rutledge
*Attorney, Agent, or Firm*—William J. Daniel

[57] ABSTRACT

Apparatus and method for processing photographic material in which the material is passed through at least one processing vessel filled with processing liquid from a supply receptacle of processing liquid. Each vessel is filled by means of a liquid delivery pump which operates under the control of a liquid level sensing means sensing the level of processing liquid in the vessel and actuating the pump when the sensed level falls below a predetermined level. In order to regenerate the processing liquid in use over time, a predetermined quantity of processing liquid is removed periodically from at least one vessel via a discharge pump, preferably operating volumetrically, the quantity of liquid thus removed from the vessel being replaced with additional liquid from the supply receptacle to maintain the predetermined liquid level, Preferably, the supply receptacle is a flexible collapsible bag sealed to minimize deterioration of the processing liquid therein.

10 Claims, 1 Drawing Sheet

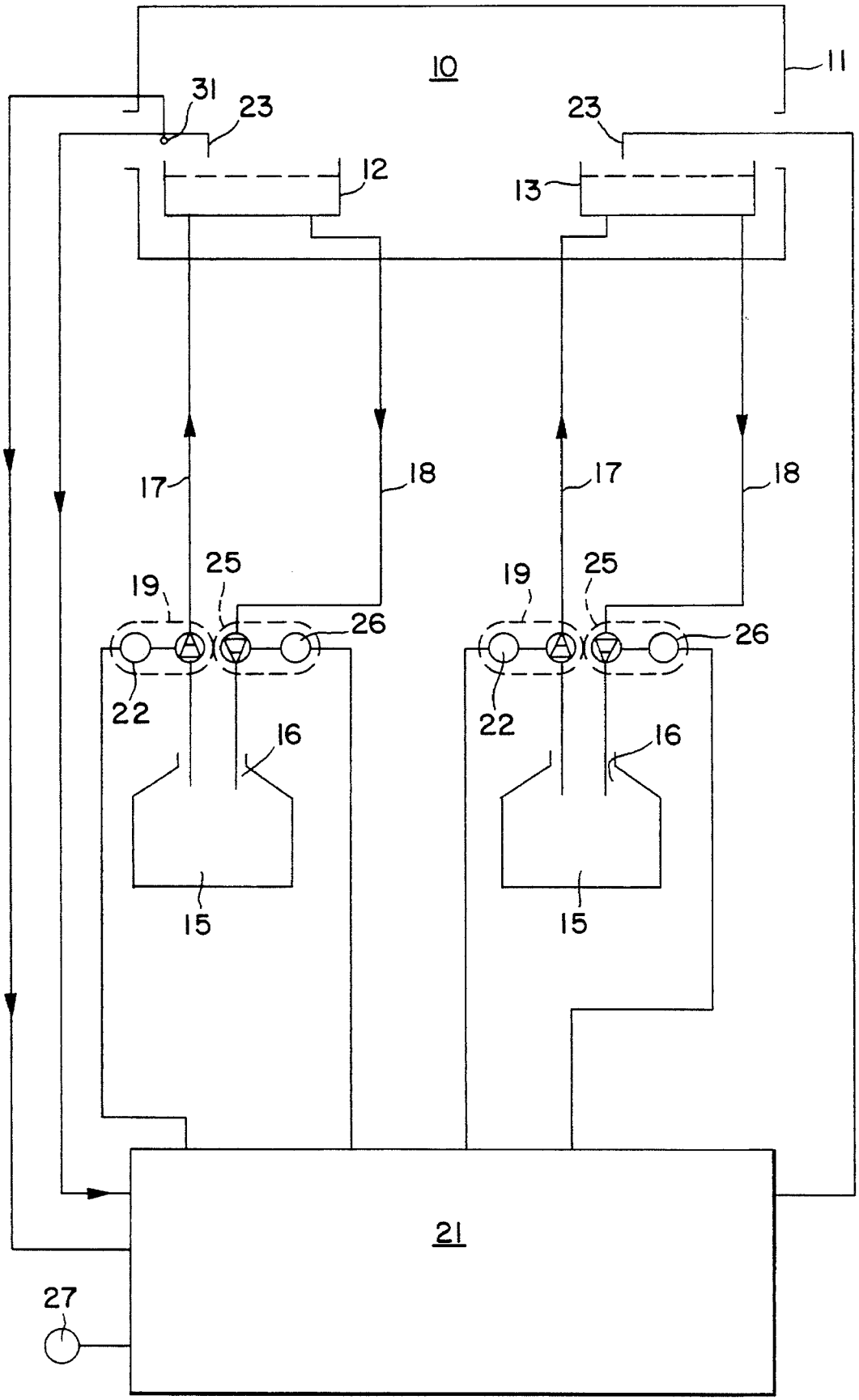
10
11
31
23
23
12
13
17
18
17
18
19
25
19
25
26
26
22
22
16
16
15
15
21
27

APPARATUS FOR PROCESSING PHOTOGRAPHIC MATERIAL AND A METHOD OF REGENERATING A PROCESS LIQUID THEREIN

FIELD OF THE INVENTION

This invention relates to apparatus for the processing of exposed photographic material, and in particular for apparatus for developing colour proofs, and a method of regeneration of the process liquid used in such apparatus.

BACKGROUND TECHNOLOGY

In the development of proofs particularly colour proofs the photographic plate will pass through a development process in which the plate passes through in turn a developing section, a fixing section, a wash section and a drying section. In the developing and fixing sections a plate typically passes through a bath of process liquid. The process liquid in the respective bath will degenerate due to chemical reaction with the photographic material, and oxidation due to contact with the air. The process liquid in the bath will drop in level due to carry-over on the photographic materials and due to evaporation. It is therefore necessary to add fresh liquid to the bath. This addition thus depends on the amount of processed material but it will be time-dependent as well.

It is known to add fresh liquid to the bath by means of so-called chicken-feed bottles that supply liquid as the liquid level in the bath lowers due to carry-over, but also due to intentional removal of used liquid in order to cause spontaneous replacement by fresh liquid for reasons of oxidation compensation. Such removal occurs by opening a discharge valve in a bottom conduit of the tank, and the used liquid flows in a waste collection vessel. A disadvantage of this system is premature oxidation of procesing liquid in the bottle.

It is further known to carry out bath control by means of so-called cubitainers, i.e. a collapsable plastic bag in a rectangular cardboard box, which is in connection with a supply conduit through which liquid is withdrawn and pumped in the processing station under the control of a level sensor in the station, and a return conduit via which liquid can return to the cubitainer. The return conduit is normally closed by a discharge valve. This valve is opened for certain periods to withdraw an amount of liquid from the bath and automatically produce thereby its replacement by fresh liquid, in order to compensate for oxidation of the bath. It has been shown that time-controlled operation of this discharge valve, unlike the valve in a chicken-feed system comprising a waste collection vessel, does not produce true time-dependent discharge rates because the air pressure in the cubitainer fluctuates as a consequence of the air-tight connection of the supply and return conduits to the cubitainer and of the changing volume of the bag caused by a progressive removal of its contents to compensate for evaporation and carry-over of processing liquid from the bath.

OBJECT OF INVENTION

The present invention provides an apparatus for processing photographic material, which includes a process bath filled with processing liquid and having discharge means for discharging a given amount of processing liquid from the bath which operates more accurately than known discharge means so that regeneration can be effected with improved accuracy.

STATEMENTS OF INVENTION

According to the invention there is provided apparatus for processing photographic material and which includes at least one process bath, each such bath in use being filled with processing liquid held in a sealed collapsible container, a delivery pump for removing liquid from said container and delivering it to said respective bath, a respective sensor for determining when the liquid has reached a predetermined level in said bath to control the delivery pump, and discharge-means for removing predetermined volumes of liquid from the bath and returning them to said container, which is characterized in that said discharge means is formed by a volumetric pump in an exit of the bath.

The apparatus may have a second sensor means for monitoring the quantity of photographic material processed in the bath and/or processor, said second sensor means also controlling the discharge means.

The process bath may be for developing and/or fixing the photographic images on a plate.

Also according to the invention there is provided a method of regenerating a process liquid in a photographic development process in which photographic material passes through a bath of said liquid, the liquid being fed to the bath to maintain the liquid level therein at a predetermined level and used liquid being discharged from the bath causing the new liquid to be fed to the bath to maintain said level, the process liquid fed to the bath being provided in an enclosed collapsible container, and discharged process liquid being received in said same collapsible container, characterised in that the discharge of said liquid occurs under volumetric control.

Preferably, the process liquid when pumped from the container can cause the container to collapse.

The invention will be described by way of example and with reference to the accompanying drawing which is a schematic diagram of an apparatus according to the present invention.

DETAILED DESCRIPTION OF THE INVENTION

With reference to the drawing there is illustrated in schematic form a processor 10 for processing photographic material and in particular for producing off-press colour proofs for accessing the quality of colour separations and colour rendition in printing.

Only those features of the processor 10 relating to the present invention will be described.

The photographic proof will in the course of its development pass through a liquid developer which develops the silver image, a liquid fixer which removes silver from the proof, a wash to remove non hardened parts and a drier. A proof will have to make four such passes to build up a full colour picture.

The processor 10 has a housing 11 which encloses a first process bath 12 and a second process bath 13, both held in suitable vessels. The first bath 12 is a development bath and the second bath 13 is a fixing bath. The development bath, in particular, is as enclosed as possible to prevent oxidation of the liquid developer in the bath 12.

Essentially the supply and regeneration of process liquid to both baths 12 and 13 is similar.

The process liquids are each supplied in a respective collapsible container 15. Containers or receptacle known as cubitainers which consist of a collapsible plastic cube inside a corrugated outer board are suitable. The mouth 16 of each container is sealed by a cap (not shown) through which a supply conduit 17 and a return conduit 18 pass. We refer to our co-pending EP application N°93 203 182.6 entitled "A cap for a liquid storage container and apparatus using such cap" wherein a particularly suitable cap system for a cubitainer is disclosed. The process liquid is delivered to the respective bath 12 or 13 through the supply conduit 17 by means of a delivery pump 19 located in the supply conduit between the respective bath and container. The delivery pump 19 has a motor 22 connected to a controller 21 which controls the operation of the pump. Each delivery pump 19 is preferably a bellows type pump.

A liquid level sensor 23 monitors the presence of liquid in each bath 12 or 13 and is connected to the controller 21 to cause the respective delivery pump 19 to supply the respective process liquid to the bath until the liquid level therein has reached a predetermined level. This will automatically compensate for loss of process liquid caused by evaporation and carry over.

A liquid discharge means in the form of an exit pump 25 is located in the return conduit 18 between each respective bath 12 or 13 and its container 15. Each exit pump 25 has a motor 26 connected to the controller 21 for operation of the respective exit pump 25. Each exit pump 25 is preferably a peristaltic type pump which gives a good shut off when the pump is inoperative. The controller 21 causes each exit pump 25 to operate for a predetermined time period after predetermined time intervals so that used liquid from the baths 12, 13 is regularly removed and returned to the respective container 15. This removes process liquid which may be degenerated due to both oxidation and use. The time interval between operations of the exit pump, and/or the time period for which the pump is operational may be controlled by a timer control 27.

The developing bath 12 may have a second sensor 31 which monitors the quantity of photographic material passing through the processor 10. Such a sensor can be of a type as described in EP Application 92 202 464.1. The second sensor 31 will additionally cause the respective exit pump 25 to also operate after a predetermined quantity of photographic material has passed through the processor 10, to compensate for developer exhausted by chemical reaction with the photographic material.

Typically a collapsible container 15 will hold approximately 6–10 times more process liquid than is in the bath the bath. In this case the baths 12 & 13 have a capacity of about 3 liters and the supply container 15 holds about 20 liters of process liquid. Since the containers 15 are sealed then the bulk of the process liquid at any given moment is prevented from reacting with the surrounding atmosphere. This slows down the oxidation process.

The exit pumps 25 are caused to operate for 13 seconds per minute and have a pump capacity of 300 mls/min. The volume of the bath returned to the container, causes consequent operation of the delivery pumps 19 under the control of level sensor 23 for regeneration of the liquid in the respective bath by delivering the same volume of fluid as that removed.

When the second sensor 31 triggers the exit pump 25 this may additionally operate to remove a large quantity of liquid from the developing bath 12, and thereby also cause regeneration of the bath contents.

With sealed collapsible containers 15 to minimize oxidation, the exit pumps 25 could cause an increase in pressure within the containers. The bellows delivery pumps 19 allow the high pressure to diffuse through the delivery pump. Alternatively pressure sensitive safety valves could be provided.

Since the delivery pumps 19 remove more liquid from the containers 15 than is returned thereto by the discharge pumps (because of evaporation and carry-over), the plastic bag of the containers will progressively collapse, no air entering the container.

Whilst the invention has been described with reference specifically to developing and fixing liquids, it will be apparent that the invention could be applied to regenerating any process liquid utilised in photographic material processing, especially such liquids which are liable to react with their surrounding atmosphere.

I claim:

1. Apparatus for processing photographic material which comprises at least one processing vessel, each such vessel in use being filled with processing liquid from a corresponding liquid supply receptacle holding a supply of processing liquid for said vessel, a delivery pump (19) and associated conduit means for removing liquid from each said receptacle and delivering liquid thus removed to the corresponding vessel, a sensor associated with each said vessel for determining when the amount of liquid therein reaches a predetermined level in said vessel and controlling the delivery pump for said vessel to maintain said predetermined level in said vessel, and discharge means for each such vessel for removing a predetermined volume of liquid from the corresponding vessel and returning the volume thus removed to the corresponding receptacle, in combination, the improvement wherein said discharge means is formed by a volumetric pump in communication with an outlet of said vessel.

2. Apparatus according to claim 1, which further comprises a timer control for operating said discharge means for a determined period of time at regular time intervals.

3. Apparatus according to claim 1, which further comprises a second sensor means for monitoring the quantity of photographic material processed in at least one of said processing vessels.

4. Apparatus according to claim 3, wherein said second sensor means is adapted to sense when a predetermined amount of material has been processed in said vessel and to then cause an addition to said vessel of a sufficient quantity of fresh processing liquid from said supply receptacle to compensate for exhaustion of processing liquid by said predetermined amount of material processed in said vessel.

5. Apparatus according to claim 1, which further comprises at least two of said processing vessels, each said vessel having a liquid level sensing means associated therewith.

6. Apparatus according to claim 1, wherein said liquid supply receptacle is a sealed collapsible bag.

7. In a method of regenerating processing liquid in a photographic development process in which photographic material passes through at least one bath of processing liquid, processing liquid is fed from a processing liquid supply receptacle to at least one said bath to maintain the liquid therein at a predetermined level, and liquid is periodically discharged from the bath causing replacement liquid to be fed to the bath to maintain said level, and discharged processing liquid is received in said receptacle, the improvement wherein the periodic discharge of said used liquid occurs under volumetric control.

8. A method according to claim 7, wherein the ratio of the volume of processing liquid present in the bath when the level of the liquid therein is at said predetermined level to the volume of said supply receptacle is in the range of 1:6 to 1:10.

9. A method according to claim 7, which includes the steps of monitoring the quantity of photographic material passed through said processing bath and after said predetermined quantity of photographic material has passed through the bath, causing processing liquid to be fed to the bath to compensate for liquid exhausted during processing.

10. A method according to claim 7 wherein said supply receptacle is a sealed collapsible bag.

* * * * *